US011712916B2

(12) United States Patent
Studnicka

(10) Patent No.: US 11,712,916 B2
(45) Date of Patent: Aug. 1, 2023

(54) NOTEBOOK WITH MAGNETIC COVER

(71) Applicant: Izabela Studnicka, Lawrence, NJ (US)

(72) Inventor: Izabela Studnicka, Lawrence, NJ (US)

( * ) Notice: Subject to any disclaimer, the term of this patent is extended or adjusted under 35 U.S.C. 154(b) by 0 days.

(21) Appl. No.: 17/527,431

(22) Filed: Nov. 16, 2021

(65) Prior Publication Data

US 2022/0194113 A1 Jun. 23, 2022

Related U.S. Application Data

(60) Provisional application No. 63/128,884, filed on Dec. 22, 2020.

(51) Int. Cl.

| | |
|---|---|
| ***B42D 3/12*** | (2006.01) |
| ***B42D 3/18*** | (2006.01) |
| ***B43K 23/00*** | (2006.01) |
| ***B43K 29/10*** | (2006.01) |
| ***B43L 1/00*** | (2006.01) |

(52) U.S. Cl.

CPC ..... *B42D 3/12* (2013.01); *B42D 3/18* (2013.01); *B43K 23/001* (2013.01); *B43K 29/10* (2013.01); *B43L 1/008* (2013.01); *B42P 2241/18* (2013.01)

(58) Field of Classification Search

CPC ..... B42D 3/12; B42D 3/18; B42P 2241/18; B43L 1/008

USPC ..... 434/409

See application file for complete search history.

(56) References Cited

U.S. PATENT DOCUMENTS

2003/0157472 A1* 8/2003 Castillo ..... B43L 1/008 434/409
2007/0029777 A1* 2/2007 Williams ..... B42D 5/008 281/21.1

FOREIGN PATENT DOCUMENTS

CN 201703103 U * 1/2011
CN 109383168 A * 2/2019 ..... B43K 29/08
KR 20100040584 A * 4/2010
KR 20210060148 A * 5/2021

OTHER PUBLICATIONS

CN-201703103-U English Translation (Year: 2011).*
KR20210060148A English Translation (Year: 2021).*
KR20100040584A English Translation (Year: 2010).*
CN-109383168-A English Translation (Year: 2019).*

* cited by examiner

*Primary Examiner* — Kyle R Grabowski
(74) *Attorney, Agent, or Firm* — Brennan, Manna & Diamond, LLC

(57) ABSTRACT

The present invention relates generally to the field of writing notebooks and tablets, in particular a magnetic notebook and magnetic writing utensil system. The system includes a notebook with a magnetic zone disposed in one or both of the front and rear cover, and a magnetic writing utensil which can be attached to either cover. Further, the magnetic writing utensil has an integrated LED light that illuminates the writing surface and the tip of the utensil.

15 Claims, 5 Drawing Sheets

NOTEBOOK WITH MAGNETIC COVER

CROSS-REFERENCE TO RELATED APPLICATION

The present application claims priority to, and the benefit of, U.S. Provisional Application No. 63/128,884, which was filed on Dec. 22, 2020, and is incorporated herein by reference in its entirety.

FIELD OF THE INVENTION

The present invention relates generally to the field of writing notebooks and tablets. More specifically, the present invention relates to a magnetic notebook and magnetic writing utensil system, which can be used to personalize the notebook or tablet and to create updated themes on a regular basis. The system is comprised of a notebook with a magnetic front and/or rear cover and a magnetic writing utensil that can be attached to either cover or both covers. Further, the magnetic writing utensil has an integrated LED light that illuminates the writing surface and the tip of the utensil. Accordingly, the present disclosure makes specific reference thereto. Nonetheless, it is to be appreciated that aspects of the present invention are also equally applicable to other like applications, devices and methods of manufacture.

BACKGROUND

Many individuals write in a notebook daily for work, school, or personal writing, journaling diary entries, drawing and other similar activities. At night, writing in a notebook may be incredibly difficult without a light nearby to illuminate the writing surface of the notebook. As a result, existing notebooks known in the art cannot be efficiently or effectively used at night or in dimly or poorly lit conditions, without an external light source. Further, an individual may need to quickly write something down in a notebook and may have misplaced his or her writing utensil, such that it cannot be quickly found and as a result the individual cannot write what he or she desired. Accordingly, existing notebooks known in the art are also undesirable, as they cannot easily secure a writing utensil.

Therefore, there exists a long-felt need in the art for an improved system using a notebook and writing implement. There also exists in the art a long-felt need for a system including a notebook and writing utensil, that allows a user to easily write in the notebook at night or in low-light conditions without an external light source. Further, there exists a long-felt need in the art for a notebook that retains a writing utensil, such that the writing utensil can be easily located for use.

The subject matter disclosed and claimed herein, in one embodiment thereof, comprises a magnetic notebook and magnetic writing utensil system. The system has a notebook with a magnetic front and rear cover, in which a magnetic writing utensil can be attached to either cover. Further, the magnetic writing utensil has an integrated LED light that illuminates the writing surface and the tip of the utensil to facilitate writing or drawing in poor lighting conditions. The system may also have a storage case for the notebook and a writing utensil that contains a waterproof rubber gasket.

In this manner, the magnetic notebook and magnetic writing utensil system of the present invention accomplishes all of the forgoing objectives and provides an improved notebook and system for use therewith. The system can be used at night or in dimly or poorly illuminated conditions, without the need for an external light source, which is extremely advantageous to a user. Further, the system ensures the writing utensil cannot be easily misplaced, as it can be magnetically attached to the notebook.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a magnetic notebook and magnetic writing utensil system. The system includes a notebook with a magnetic front and or rear cover, a magnetic writing utensil that can be attached to the notebook and a case that can house the notebook and writing utensil for ease of transport and protection. Each cover may be manufactured from a magnetic or magnetized material, or may have at least one embedded magnet within the cover material, such that the writing utensil can magnetically attach to one or both covers. The front cover and the rear cover are further attached to one another via a spine, that also may be magnetic, magnetized or contain at least one magnet. The spine binds a plurality of pages of a writing surface within the notebook. The writing surface may be lined or unlined, and preferably contains a list of each month and day, such that a user can circle the month, date, hour or other increment of the day the use has written a note within the notebook.

The system also includes a magnetic writing utensil that may be manufactured from a magnetic or magnetized material or may have at least one embedded magnet to allow the utensil to be magnetically-attached to either cover of the notebook. The body also has a clip to affix the utensil to a pocket, as well as a retractable tip that can be retracted by a clicking or other withdrawing mechanism. In differing embodiments, the tip may be an ink pen, marker or pencil-type tip. The utensil body may further include an ergonomic finger groove, and a surface of the groove has an LED light. The light is further powered by an internal battery that may be disposable or rechargeable in differing embodiments. Therefore, the light can illuminate the tip and writing surface in dark or dimly lit conditions.

The system is also comprised of a carrying case that can house the notebook and utensil when not in use. The case has a top half and a bottom half that are connected by a hinge. Each half may further have a waterproof gasket to seal the case. In addition, the case may have a portable battery pack and charging cable, that can be used to recharge one embodiment of the writing utensil that is USB-rechargeable.

Accordingly, the magnetic notebook and magnetic writing utensil system of the present invention is particularly advantageous, as it allows a user to write in a notebook at night or in dimly or poorly lit conditions, without the need for an external light source. Further, the system ensures a user always has access to a writing utensil that is never lost, as it can be easily magnetically-attached to the notebook. As a result, the magnetic notebook and magnetic writing utensil system of the present invention overcomes the limitations of existing notebooks and writing utensils known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
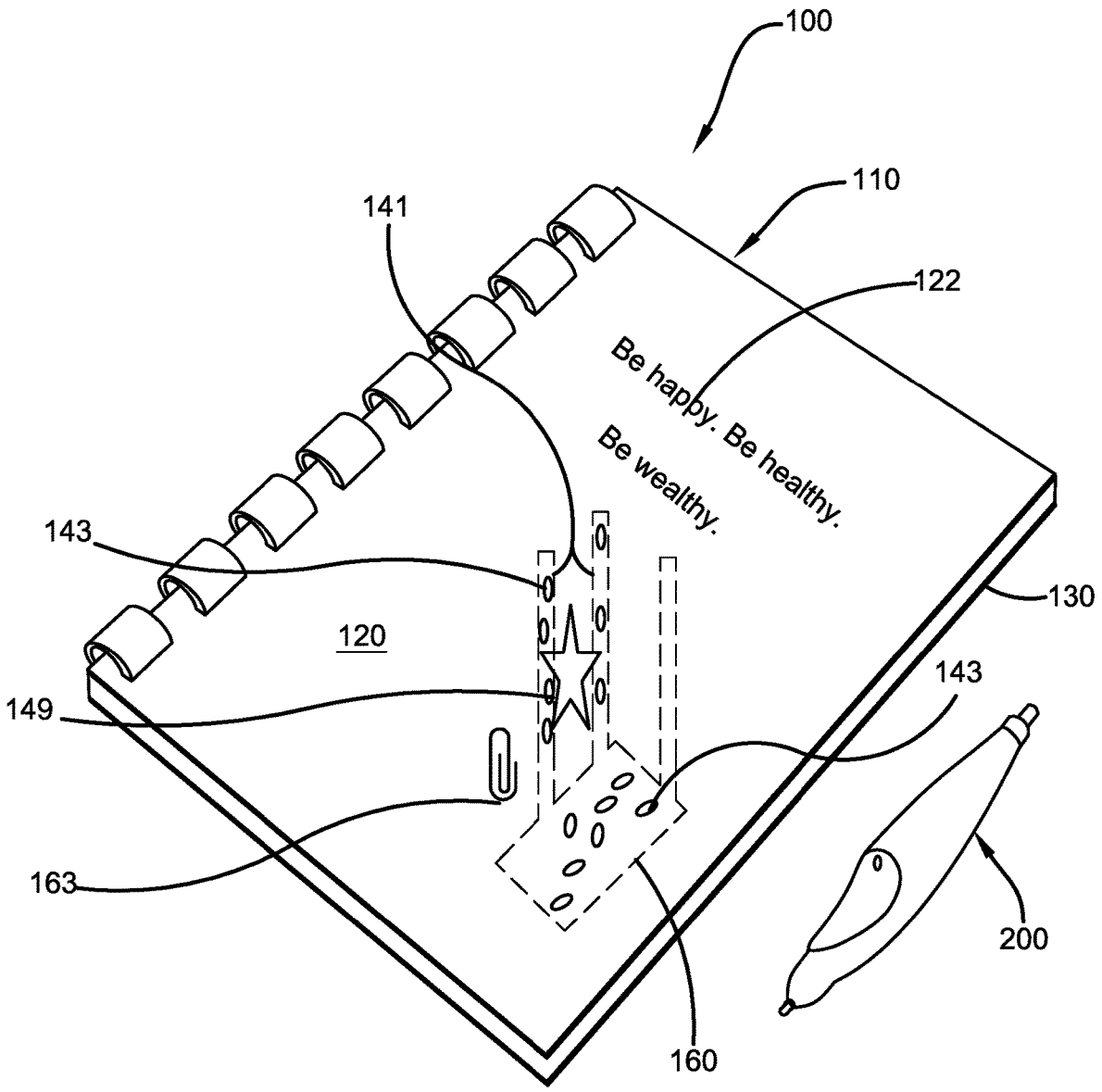
FIG. 1 illustrates a perspective view of one potential embodiment of a magnetic notebook and magnetic writing utensil system of the present invention, showing the magnetic notebook in a closed position, and wherein the magnetic utensil is not attached to the magnetic notebook in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention, and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved notebook or other writing tablet. There also exists in the art a long-felt need for a notebook or tablet and writing utensil combination that allows a user to easily write, draw or create in the notebook or tablet at night, or in dimly or poorly-lit conditions, without the need for an external light source. Further, there exists a long-felt need in the art for a notebook or tablet that retains a writing utensil, such that the writing utensil can be easily located.

The present invention, in one exemplary embodiment, is comprised of a magnetic notebook and magnetic writing utensil system. The system includes a notebook with a magnetic front and/or rear cover, a magnetic writing utensil that can attach to the cover or spine of the notebook cover and a case that can house the notebook and writing utensil, in addition to other accessories desired by the individual owner. Each front or rear cover may be manufactured from a magnetic, magnetized material, or may have at least one embedded magnet within the cover material, such that the writing utensil can be magnetically-attached to one or both covers. Alternatively, each cover may have magnetic or magnetized zones where the writing utensil, clips and other items may be easily attached. Each cover is attached to one another via a spine that also may be magnetic, magnetized or contain at least one magnet, and that also binds a plurality of pages of a writing surface within the notebook. The writing surface may be lined or unlined, and preferably contains a list of each month and day, such that a user can circle the month/date of the day he or she has written a note within the notebook.

The system also includes a magnetic writing utensil. The utensil may be manufactured from a magnetic, magnetized material, or may have at least one embedded magnet to allow the utensil to be magnetically-attached to either cover of the notebook or spine. The body also has a clip to attach the utensil to a pocket, in addition to a retractable tip. The tip may be retracted by a clicking or other withdrawing mechanism, and may be an ink pen, marker or pencil-type tip in differing embodiments. The body of the writing utensil further includes an ergonomic finger groove. A surface of the groove has an LED light that is powered by an internal battery, which may be disposable or rechargeable in differing embodiments. Therefore, the light can illuminate the tip and the writing surface in dark or dimly lit conditions.

The system is also comprised of a carrying case that can house the notebook or tablet and utensil when not in use. The case has a top half and a bottom half. Each half is connected by a hinge along one side edge of each of the top and bottom half, and each half may further be comprised of a waterproof or other rubber-like gasket to seal the case. In addition, the case may have a portable battery pack and charging cable, that can be used to recharge one embodiment of the writing utensil that is USB-rechargeable.

Accordingly, the magnetic notebook and magnetic writing utensil system of the present invention is particularly advantageous, as it allows a user to write in a notebook at night or in dimly or poorly lit conditions, without the need for an external light source. Further, the system ensures a user always has access to a writing utensil that is never lost, by allowing the writing utensil to be magnetically-attached to the notebook. As a result, the magnetic notebook and magnetic writing utensil system of the present invention overcomes the limitations of existing notebooks and writing utensils known in the art.

Referring initially to the drawings, FIG. 1 illustrates a perspective view of one potential embodiment of a magnetic notebook and magnetic writing utensil system 100 of the present invention. FIG. 1 shows the magnetic notebook 110 in a closed configuration and the magnetic utensil 200 unattached to the magnetic notebook 110. The system 100 includes a notebook or writing tablet 110 with a magnetic front cover 120 and magnetic rear cover 130. A magnetic writing utensil 200 can attach to either cover 120, 130. Further, the magnetic writing utensil 200 includes an integrated LED light 2160 that illuminates the writing surface 150 and the writing tip 222 of the utensil 200. In differing embodiments, each cover 120, 130 is preferably manufactured from a lightweight material. Further, the material may be inherently magnetic (e.g., such as but not limited to a lightweight aluminum), or may be magnetized during the manufacturing process. Alternatively, each cover 120, 130 may contain at least one magnet 160, creating a magnetic zone, that is embedded within a non-magnetic material of each cover 120, 130, such that it is fully concealed from view. The magnetic zone 160 occupies an area of less than the total area of each of the front and back covers. The magnetic zone 160 can be used to hold other accessories 163, such as a paper clip that can be used to hold a place in the notebook for later reference or to clip things to a page within the notebook. In this manner, the utensil 200 can be magnetically-attached to the area of the cover 120, 130, and the magnet 160 is embedded or on any surface of the cover 120, 130 in an embodiment where both or either cover 120, 130 is fully magnetic or magnetized. In addition, the magnetic zone 160 may contain a number of magnetic particles 143 that can be moved to other areas of the cover, either through predefined channels or open areas 141. This allows a user to add other decorative elements 149 to the surface of the cover by attaching the elements 149 to the magnetic particles 143. In use, an individual takes the writing implement 200 and uses the magnet to pull the magnetic particles 143 into one or more of the channels or open areas 141. By providing the channels or open areas 141, the magnetic particles 143 are contained and can be returned to the channels or open areas 141 for later use. Further, each cover 120, 130 has any number of indicia 122, including but not limited to: patterns, logos, emblems, images, symbols, designs, letters, words, characters, animals, advertisements, brands, phrases, etc. In any embodiment, the magnet or magnetic zone 160 may be any magnet known in the art, such as but not limited to: neodymium iron boron magnets, samarium cobalt magnets, alnico magnets, ceramic magnets, ferrite magnets or combinations thereof. The front cover 120 and rear cover 130 are also attached to one another via a spine 140. In differing embodiments, the spine 140 may be non-magnetized, magnetized, magnetic or contain at least one magnet 160, such that the writing utensil 200 can magnetically attach to the spine 140.

Figure 2:
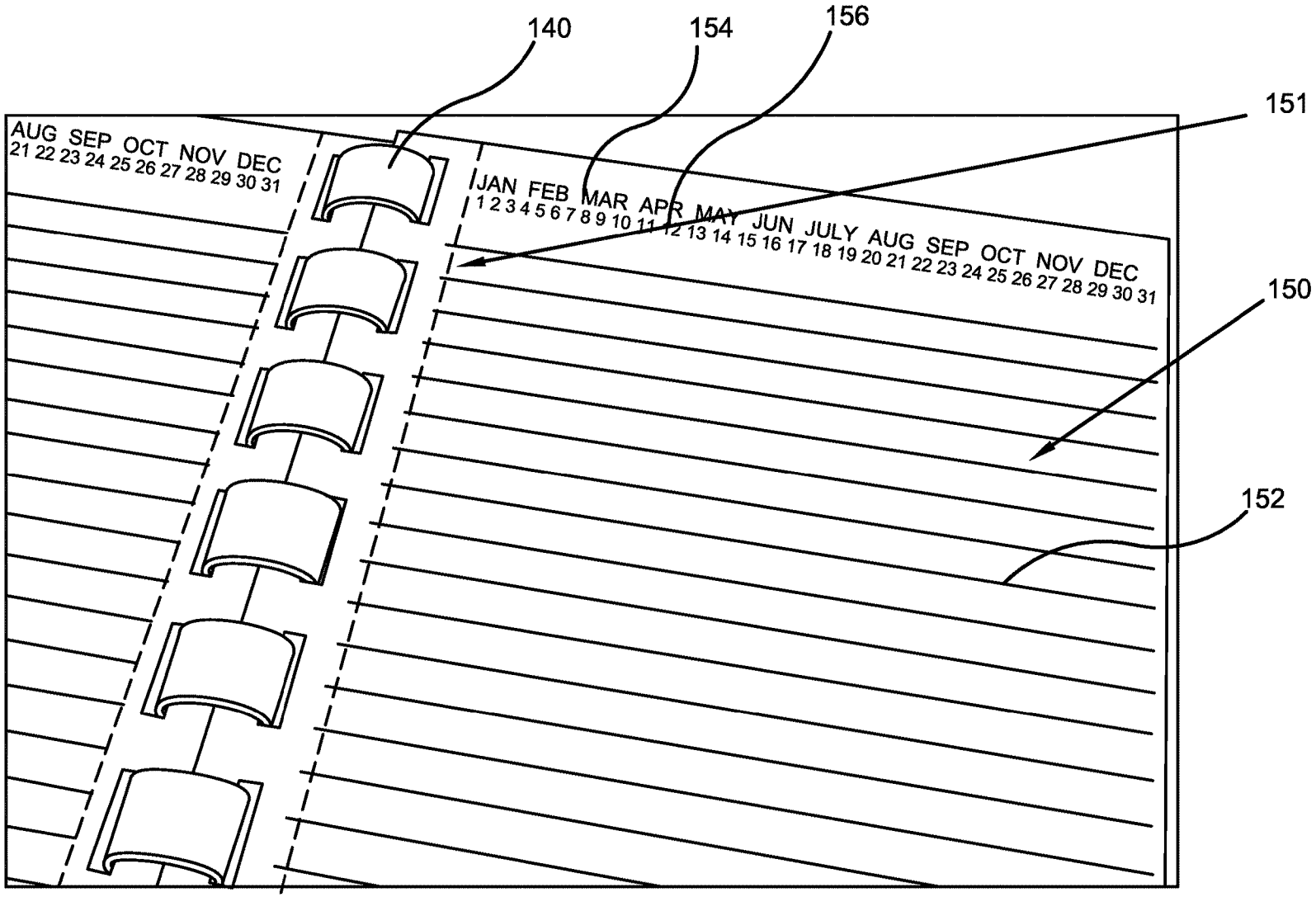
FIG. 2 illustrates a perspective view of one potential embodiment of a magnetic notebook and magnetic writing utensil system of the present invention, showing the magnetic notebook in an open position in accordance with the disclosed architecture.

FIG. 2 illustrates a perspective view of one potential embodiment of a magnetic notebook or tablet and magnetic writing utensil system 100 of the present invention, wherein the magnetic notebook 110 is in an open configuration. The spine 140 also binds a plurality of pages of a writing surface or material 150 between the front 120 and rear cover 130. The writing surface 150 is preferably paper that in differing embodiments may include, but is not limited to: writing paper, text and cover paper, index paper, tag paper, vellum bristol paper, card stock and combinations thereof. The writing material may be detachable from the spine by a line of perforations 151. Further, the surface 150 may be unlined or contain lines 152 in the form of horizontal writing lines or grids. Additionally, any portion of the writing surface 150 (but preferably the portion near the top edge of each page) may contain a plurality of indicia in the form of every month 154 and every date 156 (e.g., 1-31) of every month 154 within a calendar year, to allow a user to circle the month/day that any notes were written on the writing surface 150.

Figure 3:
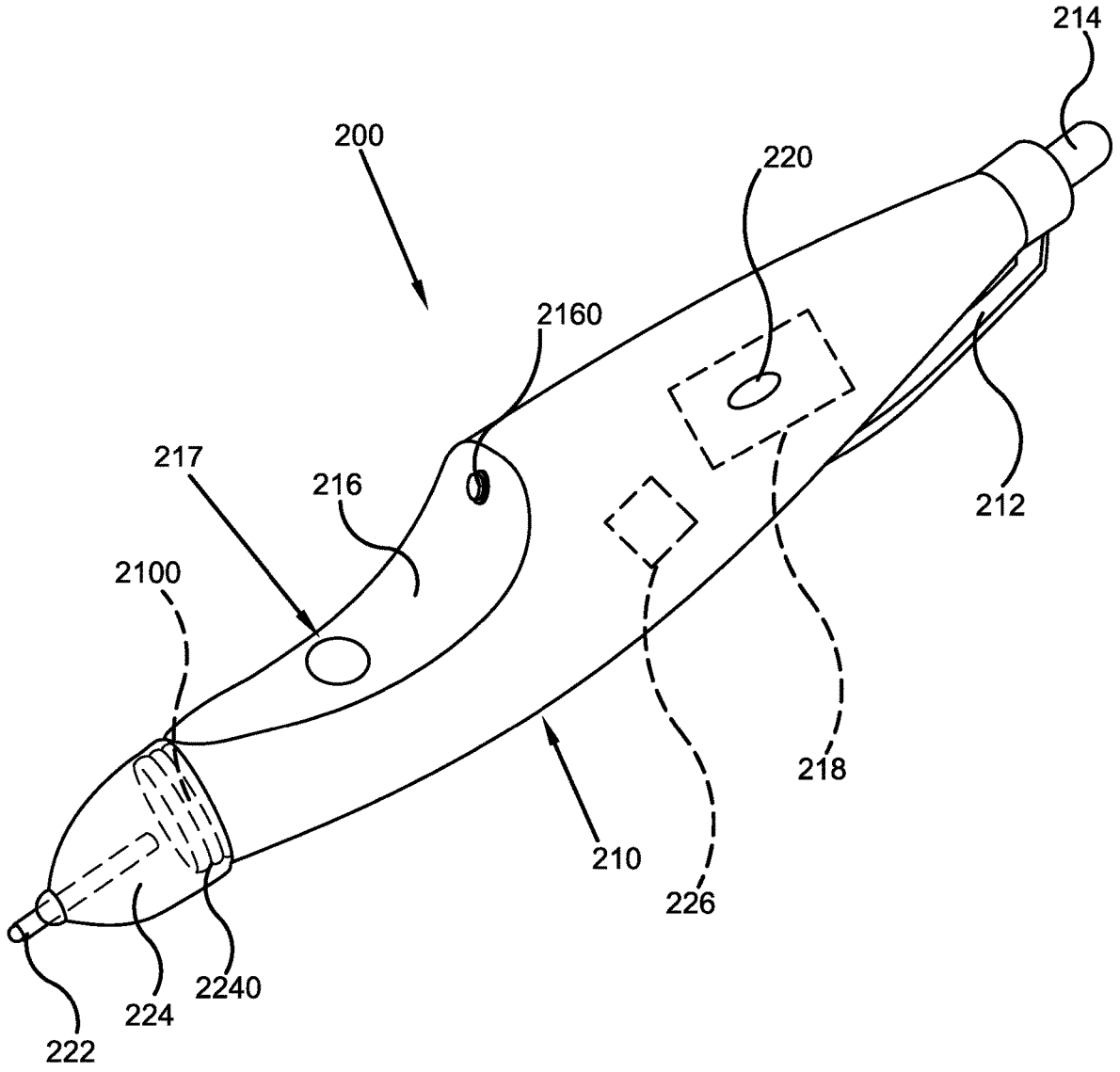
FIG. 3 illustrates a perspective view of one potential embodiment of a magnetic writing utensil of one potential embodiment of a magnetic notebook and magnetic writing utensil system of the present invention in accordance with the disclosed architecture.

FIG. 3 illustrates a perspective view of one potential embodiment of a magnetic writing utensil 200 of one potential embodiment of a magnetic notebook and magnetic writing utensil system 100 of the present invention in accordance with the disclosed specification. The writing utensil 200 is comprised of a body 210, that may be constructed from a magnetic metal or any other material that may be magnetized or contain at least one embedded magnet 226. The magnet 226 may be any magnet known in the art such as but not limited to: neodymium iron boron magnets, samarium cobalt magnets, alnico magnets, ceramic magnets, ferrite magnets or combinations thereof. The body 210 also has a removable or fixedly-attached clip 212 that allows the utensil 200 to be clipped to a pocket or the spine 140. The utensil 200 also has a writing tip 222 that can be retracted or extended by a clicking or other withdrawing mechanism 214. In differing embodiments, the tip 222 may be an ink cartridge-filled tip of any color, a colored marker or a lead/graphite (e.g., pencil) tip. The tip housing 224 may further have a plurality of threads 2240 that attach to opposing threads 2100 of the body 210, to allow a user to access the interior of the body 210 and replace the ink or other cartridge. The body 210 may also have a finger groove 216, that ergonomically engages one or more fingers of the user when a user grips the utensil 200. Any surface on the body 210 and/or finger groove 216, but preferably a surface of the finger groove 216 may contain an LED light 2160 that projects light towards the writing tip 222 and the writing surface 150 while a user is writing. This in turn allows a user to easily write at night or in dimly or poorly lit conditions, where a light source cannot be accessed. The light 2160 is powered by a rechargeable battery 218 housed within the body 210, that may be recharged via a USB port 220 which may be a USB-A, USB-B, Micro-B, Micro-USB, Mini-USB or USB-C port. The light may be turned on by a switch pad 217. In addition, an alternative embodiment of the utensil 200 may have a disposable battery 218. In any embodiment, the battery 218 may be in the form of an alkaline, nickel-cadmium, nickel-metal hydride battery, etc., such as any 3V-12 volts DC battery or other conventional battery such as A, AA, AAA, etc. that supply power to the device. The term battery refers to one or more wet or dry cells or batteries of cells, in which chemical energy is converted into electricity and is used as a source of DC power. References to recharging or replacing batteries may refer to recharging or replacing individual cells, individual batteries of cells or a package of multiple battery cells, as is appropriate for any given battery technology that may be used.

Figure 4:
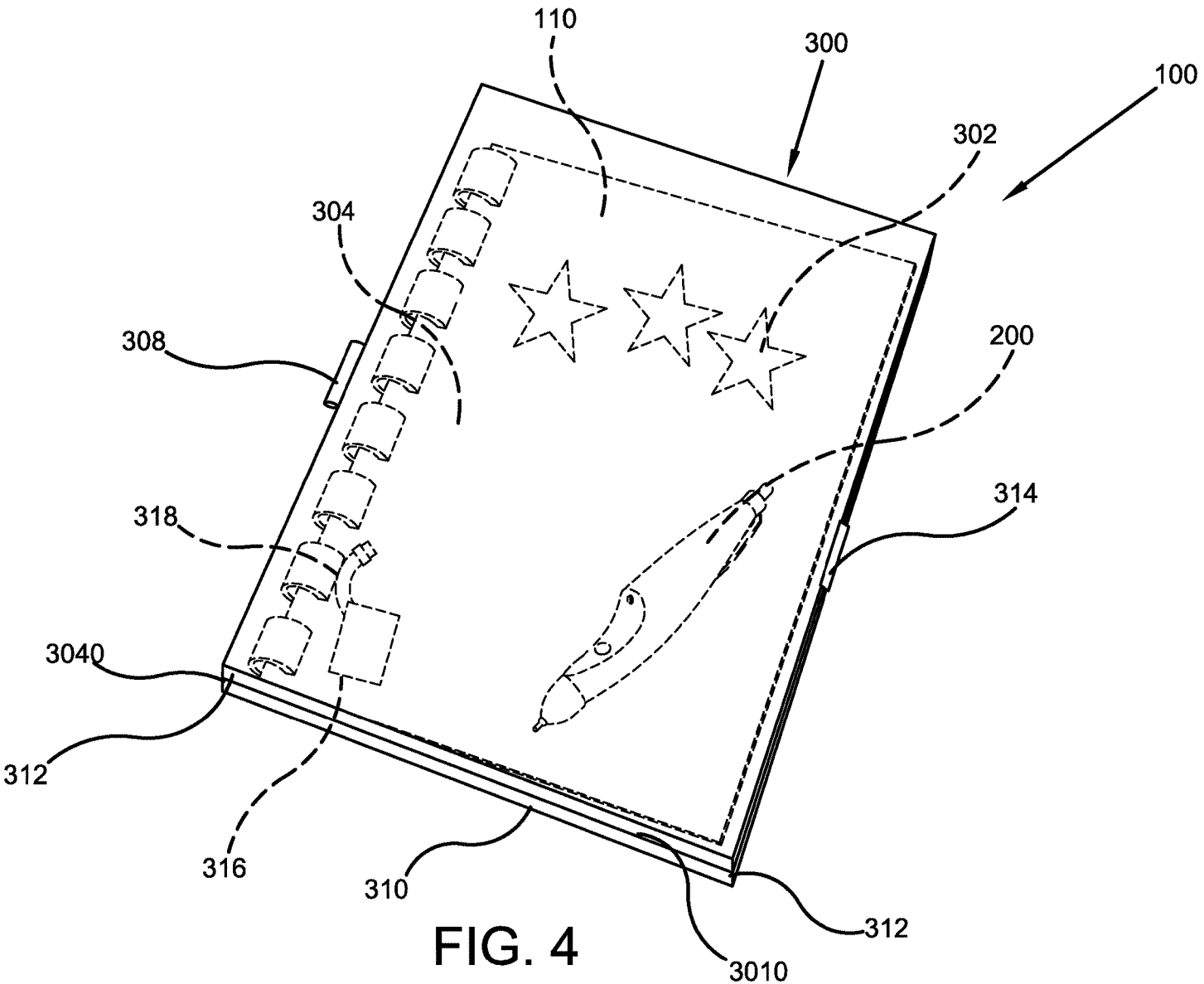
FIG. 4 illustrates a perspective view of one potential embodiment of a magnetic notebook and magnetic writing utensil system of the present invention, in which the magnetic notebook is closed and is secured within a case in accordance with the disclosed architecture.

FIG. 4 illustrates a perspective view of one potential embodiment of a magnetic notebook or writing tablet and magnetic writing utensil system 100 of the present invention. The magnetic notebook 110 is closed and is secured within a case 300, in accordance with the disclosed specification. The protective case 300 can store the notebook 110 and writing utensil 200 when not in use. The case 300 is preferably rectangular in shape, although it may be circular, square, triangular, fanciful or any other desired shape in differing embodiments. The case 300 may also be transparent, semi-transparent or opaque, and may come in a variety of colors. The case 300 has a top half 304 and bottom half 310 that are connected by at least one hinge 308, provided along one end edge of the top half and bottom half, and the hinge 308 may be any hinge type known in the art, such as but not limited to: an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gaspiston hinge, an injection molded hinge, a locking hinge, etc. A rubber gasket or other seal 312 may be fixedly or removably-attached to the bottom surface 3040 of the top half 304 and the top surface 3010 of the bottom half 310. Accordingly, the gasket 312 ensures the case 300 is water-tight or waterproof. Further, any surface of each half 304, 301 may have any number of indicia 302, including but not limited to: patterns, logos, emblems, images, symbols, designs, letters, words, characters, animals, advertisements, brands or combinations thereof. The case 300 can also be further secured via a lock 314, that in differing embodiments may be a bio-metric fingerprint lock, a lock and key lock, a padlock, a keypad lock, a dial-combination lock or some combination thereof. The case 300 may also contain an integrated or removable USB power bank or portable battery 316 and USB charging cord 318, that may be a USB-A, USB-B, Micro-B, Micro-USB, Mini-USB or USB-C chord that can be used to recharge the writing utensil 200.

Figure 5:
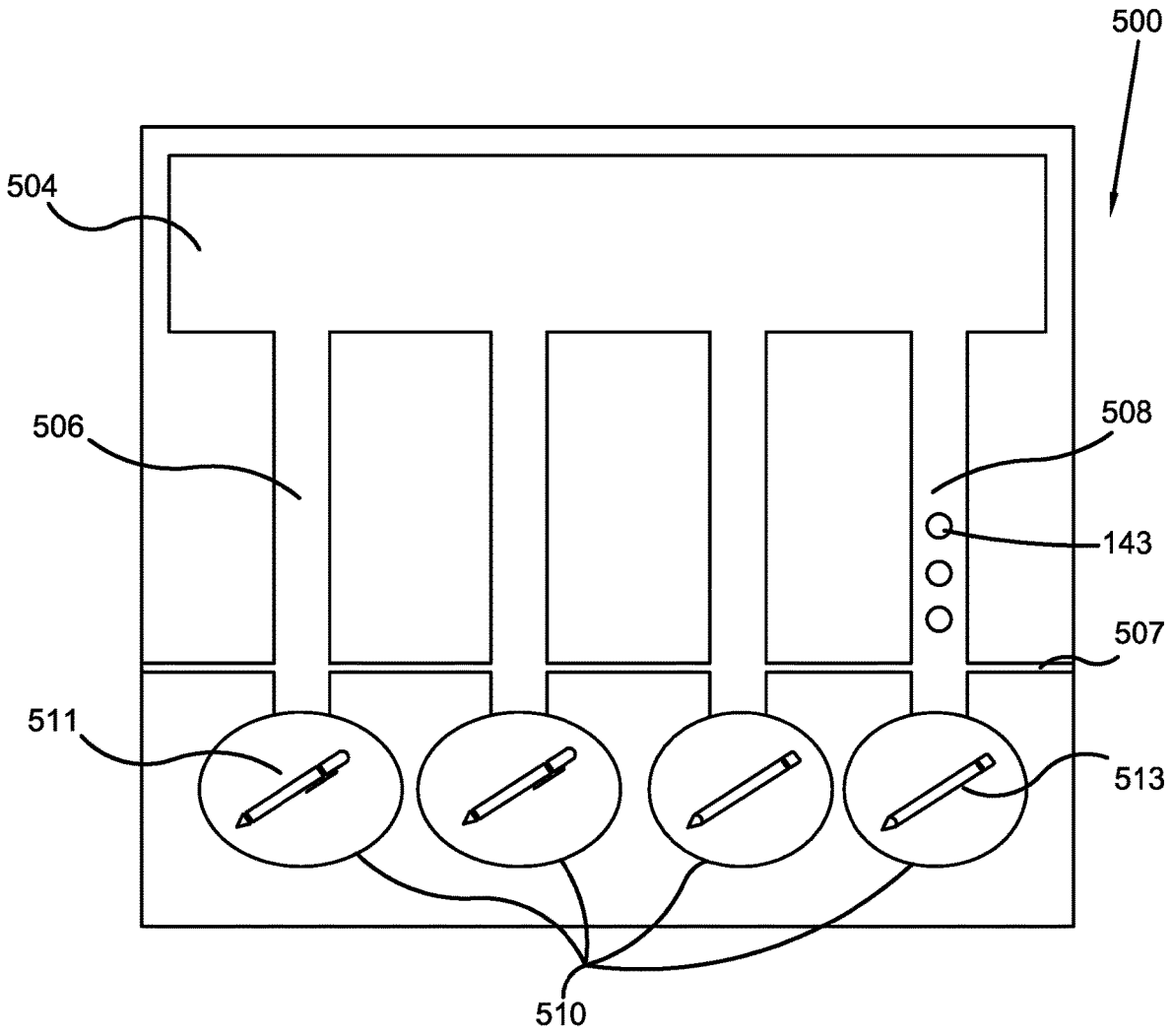
FIG. 5 illustrates a perspective view of a further embodiment of the present invention showing a creative area using the magnetic features of the notebook or writing tablet of the present invention in accordance with the disclosed architecture.

FIG. 5 provides an additional embodiment which may be included with one of the front or back covers, or may be an internal board that provides additional functionality to an individual. The creative pad 500 has a plurality of different colored areas 510 which may contain different colors of magnetic particles, which can be used to place different designs, in the design area 504. The magnetic particles are moved to the design area 504 by channels 506 and 508 by the magnetic surface on the writing instrument. The design area 504 is separated from the supply of magnetic particle containment areas 510 by border 507, which may also be magnetized to keep the magnetic particles from escaping the areas 510, when for example the notebook is inverted or being carried. In an alternatively embodiment, the colored areas 510 may be used to hold different types or different colored writing implements 511 and 513, so that the individual can choose different colors or different instruments for writing, drawing or creating in their notebook.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "magnetic notebook and magnetic writing utensil system" and "system" are interchangeable and refer to the magnetic notebook and magnetic writing utensil system 100 of the present invention.

Notwithstanding the forgoing, the magnetic notebook and magnetic writing utensil system 100 of the present invention and its various components can be of any suitable size and configuration as is known in the art without affecting the overall concept of the invention, provided that they accomplish the above-stated objectives. One of ordinary skill in the art will appreciate that the size, configuration and material of the magnetic notebook and magnetic writing utensil system 100 as shown in the FIGS. are for illustrative purposes only, and that many other sizes and shapes of the magnetic notebook and magnetic writing utensil system 100 are well within the scope of the present disclosure. Although the dimensions of the magnetic notebook and magnetic writing utensil system 100 are important design parameters for user convenience, the magnetic notebook and magnetic writing utensil system 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A notebook comprising:

a front cover;

a back cover;

a plurality of sheets of material disposed between the front and back cover;

a spine connecting each of the front cover, the back cover and plurality of sheets of material together, wherein at least one of the plurality of sheets of material comprises a line of perforations for separating the at least one of the plurality of sheets of material from the spine;

a magnetic zone embedded within at least one of the front and back covers, wherein the magnetic zone occupies less than an area of the at least one of the front and back covers and comprises a plurality of predefined channels;

a plurality of magnetic particles retained within the magnetic zone;

and at least one of a writing instrument or other accessory releasably attached to the magnetic zone comprising a replaceable cartridge filled tip; and wherein the plurality of magnetic particles are moved through the plurality of predefined channels of the magnetic zone via the at least one writing instrument.

2. The notebook as recited in claim 1, wherein the magnetic zone comprises a magnetized material selected from a neodymium iron boron magnet, a samarium cobalt magnet, an alnico magnet, a ceramic magnet, a ferrite magnet, or a combination thereof.

3. The notebook as recited in claim 1, wherein the magnetic zone is embedded in each of the front and rear covers and the spine comprises a magnetized material.

4. The notebook as recited in claim 1, wherein the writing instrument comprises an LED light.

5. The notebook as recited in claim 4, wherein the LED light is actuated by a switch pad contained within a housing of the writing instrument.

6. The notebook as recited in claim 4, wherein the writing instrument has a recessed area for finger placement.

7. The notebook as recited in claim 4, wherein the writing instrument comprises a material for connecting to the magnetic zone.

8. The notebook as recited in claim 7, wherein the material is a magnetic material for attaching to the magnetic zone.

9. A system for using a notebook in a poorly illuminated area, the system comprising:

a notebook comprised of a front cover, a back cover, and a plurality of sheets of material disposed between the front and back covers, wherein each of the front cover, the back cover and the plurality of sheets or material is connected by a spine;

a magnetic zone embedded within at least one of the front and back covers, wherein the magnetic zone occupies less than an area of the at least one of the front and back covers and comprises a plurality of predefined channels;

a plurality of magnetic particles retained within the magnetic zone; and at least one writing instrument comprised of a recessed area for accommodating a finger, a LED light actuatable to illuminate a writing area, and a replaceable cartridge filled tip, wherein the at least one writing instrument is attached to the at least one of the front and back covers by the magnetic zone; and wherein the plurality of magnetic particles are moved through the plurality of predefined channels via the at least one writing instrument.

10. The system as recited in claim 9, wherein the LED light is actuatable by a switch disposed within the recessed area.

11. The system as recited in claim 10, wherein the LED light rechargeable by a USB port.

12. The system as recited in claim 9, wherein the magnetic zone contains a magnetized material selected from neodymium iron boron magnets, samarium cobalt magnets, alnico magnets, ceramic magnets, ferrite magnets, or combinations thereof.

13. The system as recited in claim 9, wherein the plurality of magnetic particles are movable through the plurality of predefined channels in the magnetic zone to form an attachment point for accessories.

14. The system as recited in claim 9, wherein the system further comprises a case sized and configured to hold the notebook and the at least one writing instrument.

15. A notebook and writing instrument combination comprising:

a notebook having a plurality of sheets for receiving writing, with the plurality of sheets connected to a front cover and back cover by a spine;

each of the front cover and back cover having a magnetized area which is less than an area of each of the front cover and back cover, wherein each magnetized area comprises a plurality of predefined channels;

a plurality of magnetic particles retained within each magnetized area;

a writing instrument having a magnet and removably attached to the magnetized area, the writing instrument having a LED light, a recessed gripping area disposed in a body of the writing instrument, and a replaceable cartridge filled tip, with the LED light actuatable by a switch disposed in the gripping area; and a case for hold each of the notebook and writing instrument and the case having a battery for recharging the LED light of the writing instrument; and wherein the plurality of magnetic particles are moved through the plurality of predefined channels of the magnetic areas via the at least one writing instrument; and wherein the plurality of magnetic particles comprise a plurality of different colored particles and each of the predefined channels retains a single color of the different colored particles.

* * * * *